US006040491A

United States Patent [19]

Sjöwall

[11] Patent Number: 6,040,491

[45] Date of Patent: Mar. 21, 2000

[54] METHOD AND APPARATUS HANDLING RADIOACTIVE WASTE MATERIAL

[75] Inventor: Sony Sjöwall, Varberg, Sweden

[73] Assignee: Vattenfall AB, Stockholm, Sweden

[21] Appl. No.: 08/913,047

[22] PCT Filed: Mar. 7, 1996

[86] PCT No.: PCT/SE96/00306

§ 371 Date: Sep. 30, 1997

§ 102(e) Date: Sep. 30, 1997

[87] PCT Pub. No.: WO96/28828

PCT Pub. Date: Sep. 19, 1996

[30] Foreign Application Priority Data

Mar. 10, 1995 [SE] Sweden ..... 9500881

[51] Int. Cl.[7] ..... G21F 9/00; G21F 9/04

[52] U.S. Cl. ..... 588/16; 588/20; 588/900; 976/DIG. 380; 976/DIG. 385; 976/DIG. 395; 210/770; 210/805; 210/808; 210/406; 210/416.1; 210/484; 210/237; 210/248; 294/77

[58] Field of Search ..... 588/1, 900, 16, 588/20; 976/DIG. 385, DIG. 379, DIG. 380, DIG. 395; 210/770, 805, 808, 405, 406, 416.1, 483, 484, 237, 248; 294/77

[56] References Cited

U.S. PATENT DOCUMENTS

| | | | |
|---|---|---|---|
| 4,983,282 | 1/1991 | Roy et al. | 210/104 |
| 5,022,995 | 6/1991 | Roy et al. | 210/651 |
| 5,143,615 | 9/1992 | Roy et al. | 210/350 |
| 5,227,060 | 7/1993 | Roy et al. | 210/258 |
| 5,804,069 | 9/1998 | Eriksson | 210/774 |

*Primary Examiner*—Robert J. Popovics
*Attorney, Agent, or Firm*—Burns, Doane, Swecker & Mathis, L.L.P.

[57] ABSTRACT

In a method and an apparatus for dewatering and containing radioactive, aqueous waste (44), the latter is introduced into a filtration container (12) and is ultimately disposed of in a disposable container structure (12, 48, 50), which comprises the filtration container (12) holding the dewatered waste (44), as well as an outer container (50) enclosing the filtration container (12). The filtration container is an inner sack (12) having a bottom (13) which is provided with a straining cloth and through which essentially all the dewatering is carried out. After the dewatering operation has been completed, the inner sack (12) is sealed and placed in the outer container (50) in order to be ultimately disposed of. For purposes of cleaning, the filtration water (17) may be recirculated through the waste during the dewatering operation.

21 Claims, 4 Drawing Sheets

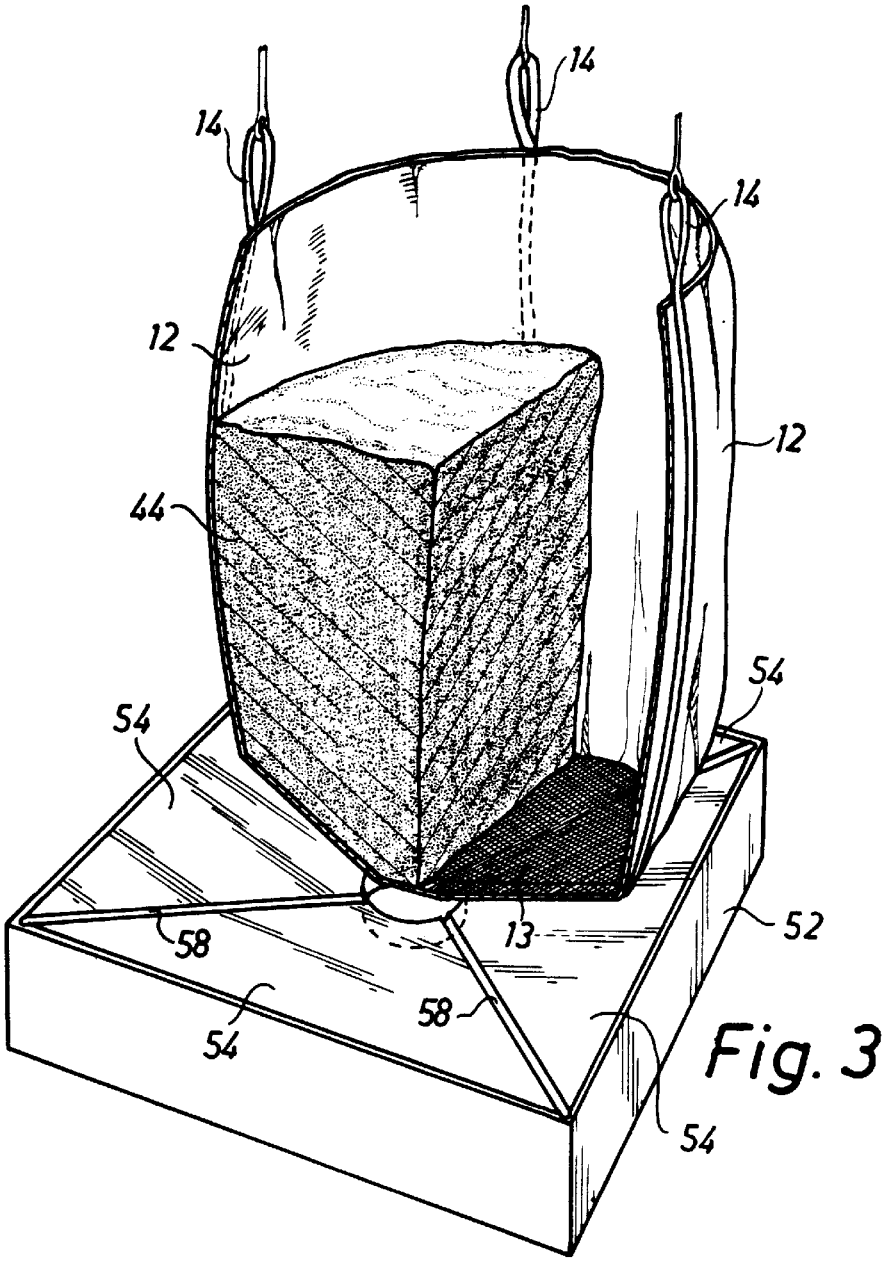
Fig. 3
Fig. 4
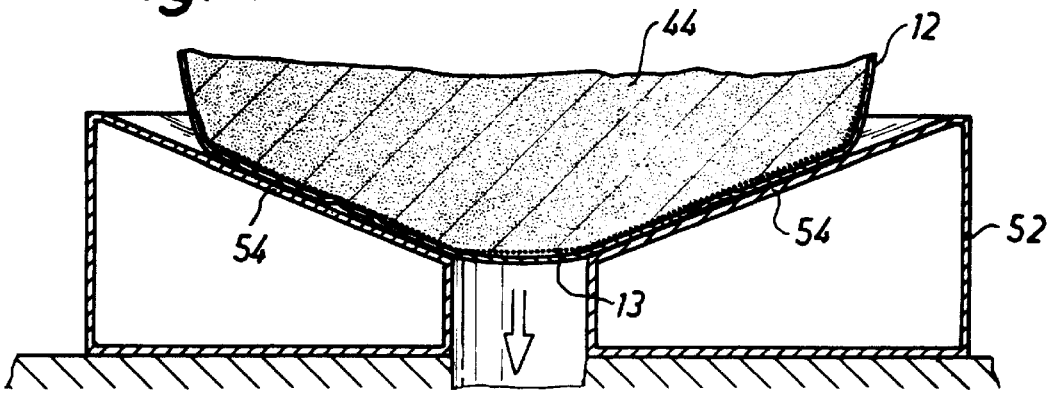

METHOD AND APPARATUS HANDLING RADIOACTIVE WASTE MATERIAL

FIELD OF THE INVENTION

The present invention generally relates to the handling and disposal of radioactive waste, in particular low-level and intermediate-level waste, from nuclear power plants.

To be more specific, the invention concerns a method for dawatering and containing aqueous, low-level or intermediate-level waste, as well as an apparatus for implementing this method.

DESCRIPTION OF THE PRIOR ART

Low-level waste from nuclear power plants occurs, inter alia, in the form of contaminated ion-exchange material obtained when cleaning the aqueous phase of the secondary side of leaking steam generators. Such cleaning may be performed in what is commonly referred to as ion-exchange beds containing a suitable amount of ion-exchange material, for instance in the order of 2000 kg per bed. As the ion-exchange material is spent and replaced with fresh material, the spent, low-level and aqueous ion-exchange material has to be taken care of in some suitable fashion. The activity of this material may be in the order of, say, $25\times10^3$ Bq/kg, for which reason this material cannot be deposited as it is on the ground.

In a conventional method for handling such aqueous, low-level ion-exchange material, the material is embedded in a concrete or sheet-metal chill mould having an external volume of 1.7 $m^3$. To this and, the aqueous, low-level ion-eaxchange material is mixed with cement under agitation in an empty chill mould in order to form a solid matrix having a volume in the order of 1 $m^3$. The ion-exchange material proper then makes up, say, only 0.7 $m^3$. Finally, a concrete lid is cast over the matrix in order to seal the chill mould. The finished chill mould is then ultimately disposed of in some suitable deposition compartment.

However, the containment technique described above is inconvenient in many respects. First, this technique is far too expensive. The material cost for making a single concrete chill mould of the above type may amount to SEK 10,000. Second, this technique means that the deposition compartment in which the chill moulds are to be placed is poorly utilised as to volume. Thus, but a small amount of the total volume of the chill mould is made up of radioactive waste, the remainder consisting of the concrete shell, the cement in the core as well as socalled void water accompanying the contaminated ion-exchange material from the bed. Accordingly, this prior-art technique is anything but cost-effective.

A further inconvenience of the prior-art technique is that the ion-exchange material will, owing to its content of various chemical additives serving to improve the ion-exchange function, exhibit an unfavourable pH value rendering the embedment procedure more complicated.

GB-A-2,216,034 teaches a disposable container structure for dewatering radioactive, aqueous waste by means of centrifugation. The container structure comprises a cylindrical, rigid inner container, which is integrated with a top lid and whose cylindrical circumferential wall and bottom both are water-permeable but not permeable to solid material, as well as a cylindrical, watertight and rigid outer container, in which the inner container is accommodated with a small gap towards the inner surface of the outer container, which is sealingly applied against the top lid of the inner container. The aqueous waste is supplied to the inner container through an opening in the top lid while the entire container structure, i.e. both the inner and the outer container, is rotated in a frame about a vertical centre axis of the container structure. As a result, water is by centrifugal action expelled radially through the filtrating circumferential wall of the inner container and introduced into a gap between the inner and the outer container, whence it is conducted through a lateral opening in the upper end of the outer container to be further disposed of. The centrifugation is carried out during the filling operation as well as for some time (5–10 min) after the filling operation has been completed. After the centrifugation has been completed, all the openings in the container structure are sealed, and the container structure is then removed from the centrifugation stand in order to be ultimately disposed of below ground.

The technique taught in GB-A-2,216,034 is disadvantageous not only in that the container structure is highly complicated and, hence, expensive, but also in that the water removed by centrifugal action may well have an unacceptably high activity, necessitating further processing of the water.

Further, U.S. Pat. No. 4,058,479 discloses a technique which is similar to that of GB-A-2,216,034, but in which the water expelled out through a filtrating circumferential wall of an inner container instead remains as a protective layer between the inner and the outer container. According to this prior-art technique, water is added intentionally before the waste is placed in the inner container.

SUMMARY OF THE INVENTION

A general object of this invention is to enable more cost-effective and rational dewatering of aqueous, low-level or intermediate-level waste, as well as the containment thereof.

A specific object of the invention is, therefore, to provide a method and an apparatus achieving inexpensive and effective dewatering of void water from such waste before this is contained with a view to ultimate disposal, the storage of such void water being thus avoided.

Another specific object of the invention is to provide a method and an apparatus enabling a reduction of the total cost of the containment of the waste and involving effective utilisation of the volume of the compartments in which the waste is to be ultimately disposed of.

A particular object of the invention thus is to reduce the total volume of waste, including the container structure, that is to be ultimately disposed of.

Another object of the invention is to provide a method and an apparatus which do not require the use of any complicated container structure.

According to the invention, these and other objects are achieved by a method and an apparatus having the distinctive features recited in the appended claims, preferred embodiments being defined in the dependent claims.

An embodiment of the invention will now be described in more detail with reference to the accompanying drawings.

BRIEF DESCRIPTION OF THE DRAWINGS

In the drawings,

FIG. 3 is a partly cut perspective view of a suction box on which is placed a filled inner sack of the type shown in FIG. 2, FIG. 4 is a broken-away vertical section of the arrangement shown in FIG. 3.

DESCRIPTION OF AN EMBODIMENT

Figure 1:
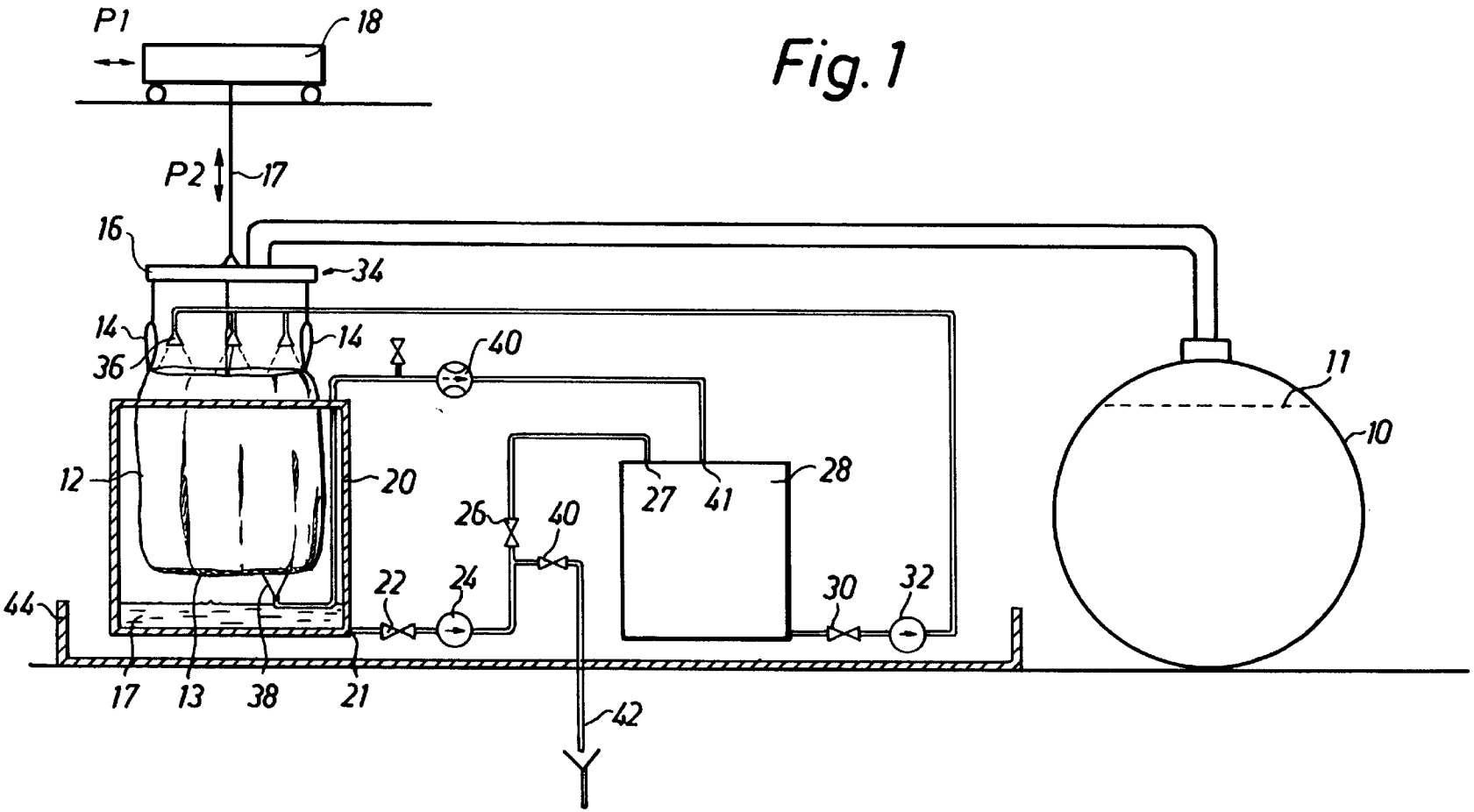
FIG. 1 is a skeleton diagram (not drawn according to scale) of an exemplifying embodiment of an apparatus for implementing the method according to the invention.

FIG. 1, to which reference is now made, illustrates an embodiment of an apparatus according to the invention for dewatering and containing low-level or intermediate-level waste, which for exemplifying purposes is here assumed to consist of spent ion-exchange material as above. Thus, the ion-exchange material may originate from an ion-exchange filter for cleaning the aqueous phase at the secondary side of steam generators in nuclear power plants. The material may have an activity in the order of 5,000–300,000 Bq/kg, thus exceeding the limit value for direct deposition, consequently, the material is dewatered, contained and tested as to its contents of nuclides before being deposited, preferably in the ground.

The apparatus shown in FIG. 1 comprises a storage tank 10, a bigbag-type inner sack 12 provided with a straining-cloth bottom 13 and being, with the aid of four lifting eyes 14, suspended from a lifting yoke 16, which in turn is suspended from a travelling (P1) trolley 18 via 17. The inner sack 12 is vertically adjustable (P2) in an upwardly open, rust-proof collecting container 20, which has a lower outlet 21 which, via a valve 22, a pump 24 and a valve 26, is connected to an inlet 27 of a buffer tank 28. An outlet 29 provided at the bottom of the buffer tank 28 is, via a valve 30 and a pump 32, connected to a sprinkler 34 which is disposed above the opening of the inner sack 12 and which comprises a number of downwardly-directed spray nozzles 36, Furthermore, FIG. 1 schematically illustrates a vacuum suction nozzle 38 which is applied against the outside of the straining-cloth bottom 13 of the inner sack 12 and which, via a vacuum pump 40, is connected to a second inlet 41 of the buffer tank 28. A valve 42 connected between the pump 24 and the valve 26 enables filtration water 17 to be drawn off from the collecting container 20 to an outlet 43. Reference numeral 44 designates a retaining wall intended to intercept any spillage resulting from the process.

The Inner Sack 20

Figure 2:
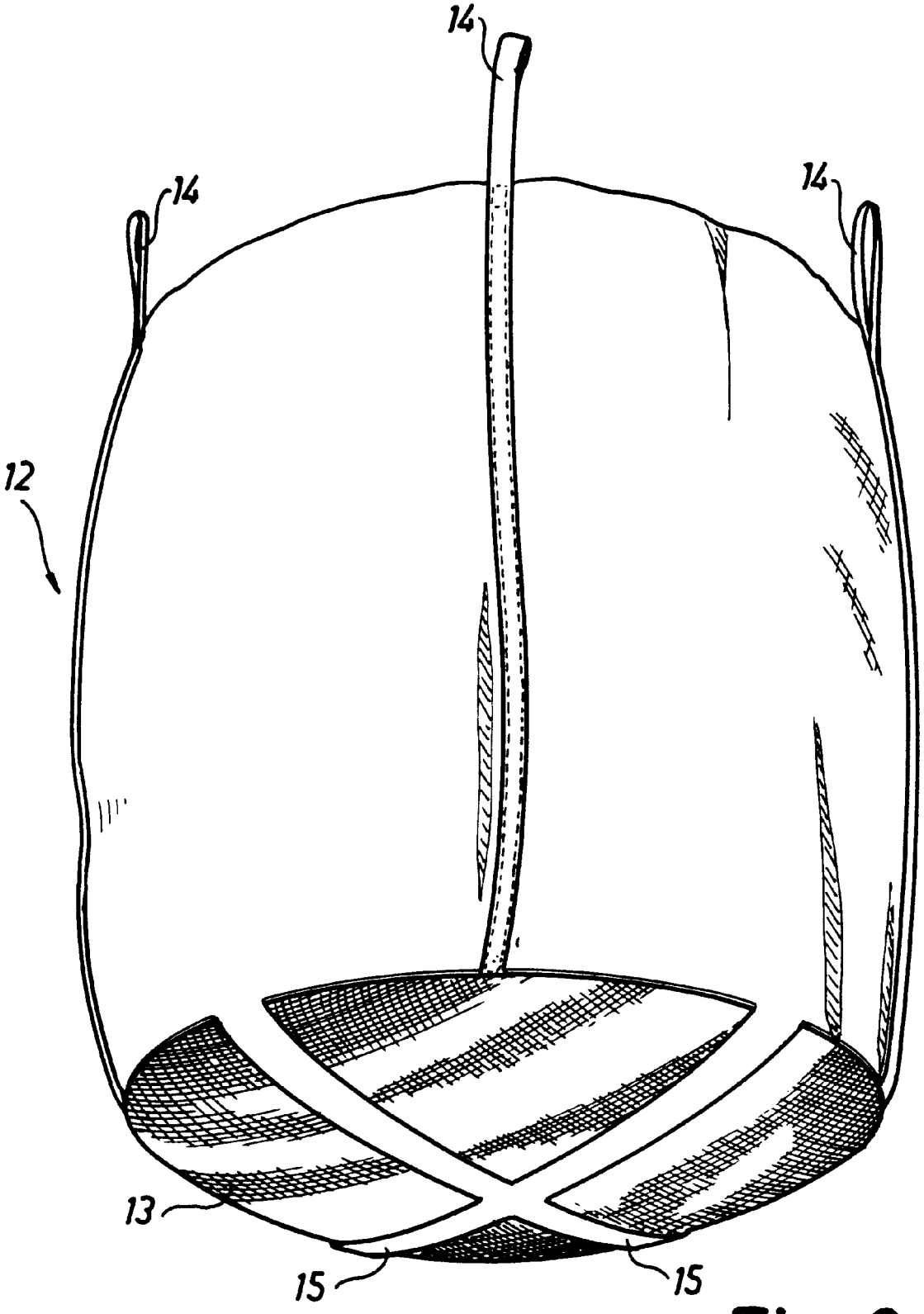
FIG. 2 is a perspective view from below of an inner sack having a bottom provided with a straining cloth.

In order to illustrate the function of the apparatus of FIG. 1, a preferred embodiment of the inner sack 12 shown in FIG. 1 will now be described in more detail with reference to FIG. 2. As indicated in the foregoing, the inner sack 12 is of bigbag type having a volume in the order of 1 $m^3$. In this example, the inner sack 12 measures 90×90×115 cm. The sides and the top of the inner sack 12 can be made of polypropylene fabric which on the inside is coated with polyethylene, whereas the bottom 13 of the inner sack is made of a straining cloth having a suitable mesh in view of the filtration. In practical tests, the mesh of the straining cloth 13 has been 125 $\mu$m. As illustrated in FIG. 2, the sack 12 is in addition provided with two crossed reinforcement bands 15, which are arranged on the outside of the straining cloth 13 and at the ends are connected to the sides of the sack 12. Furthermore, the sack 12 is at the top provided with four lifting eyes 14 of a type known per se.

According to the invention, the water permeability of the inner sack 12 is generally much higher at the straining-cloth bottom 13 than at the sides or the top. The scope of the invention encompasses the alternative that the sides and the top have a certain water permeability, however very restricted in comparison with that of the straining-cloth bottom 13, as well as the alternative that the sides and the top are essentially perfectly watertight. At any rate, the dewatering is completely or at least substantially carried out through the straining-cloth bottom 13.

Practical Test

The method according to the invention will now be described in more detail with reference to a test implemented with the aid of an apparatus of the type shown in FIG. 1.

Step 1: Filling of the Storage Tank 10

With the aid of a pumping device (not shown), the storage tank 10 was filled with aqueous, particulate and low-level ion-exchange material to a suitable level 11. The material in the storage tank 10 was then subjected to batchwise dewatering and containment in accordance with the following steps.

Step 2: Filling of the Inner Sack 12

An empty inner sack 12 of the type shown in FIG. 2 was suspended with the aid of its lifting eyes 14 from the lifting yoke 16 and was lowered into the collecting container 20, as illustrated in FIG. 1. By means of a submersible sludge pump (not shown) immersed in the storage tank 10, about 1 $m^3$ of aqueous ion-exchange material was then pumped from the storage tank 10 down into the suspended inner sack 12. In the test, the sack 12 initially rested on the bottom of the collecting container 20 and was subsequently raised to a level a certain distance above the bottom of the container 20 during the final filling of the straining-cloth sack 12, as illustrated in FIG. 1.

Step 3: Drainage and Recirculation

During the filling of the inner sack 12, void water (reference number 17) was drawn off from the material via the straining-cloth bottom 13 to the collecting container 20 under the action of gravity. If the filtration water 17 in the collecting container 20 rose above a suitable level (30–40 cm), the excess water was pumped to the buffer tank 28 by the pump 24.

The collected filtration water 17 was heavily contaminated (visual observation) and could thus not be directly deposited without previous treatment. It took approximately 5 min to fill up the straining-cloth sack 12, and the drawn-off volume of water was about 400 l.

In order to gradually clean the filtration water 17, the latter was recirculated via the valve 22, the pump. 24, the valve 26, the buffer tank 28, the valve 30, the pump 32 and the sprinkler 34, by means of which the filtration water 17 was evenly sprinkled over the material in the sack 12 in order to pass through this material once again and thus be further cleaned.

The recirculation involved a flow rate of approximately 10 l/min and went on (about 40 min) until the filtration water 17 was sufficiently clean (in this embodiment until the filtration water had a clear, uncoloured appearance), Measurements showed that the filtration water had a high degree of purity and essentially no activity, for which reason it could be discharged at the outlet 43.

Step 4: Drip-dewatering and Vacuum Suction

Thereafter, the sack 12 was left suspended for purposes of drip-dewatering. After about 2 h, an additional amount of about 30 l of water had been drawn off, and after 13 h, an additional amount of about 8 l had been drawn off. After 15 h, a minor amount of void water still remained at the bottom of the sack 12. In order to speed up the drawing-off of water, a movable vacuum-suction means 38, 40 was, after the drip-dewatering, applied to the outside of the straining-cloth bottom 13 at different places, resulting in powerful drawing-off of the void water remaining at the bottom of the sack 12.

Step 5: Final Packaging in Plastic and Outer Sack

Figure 5:
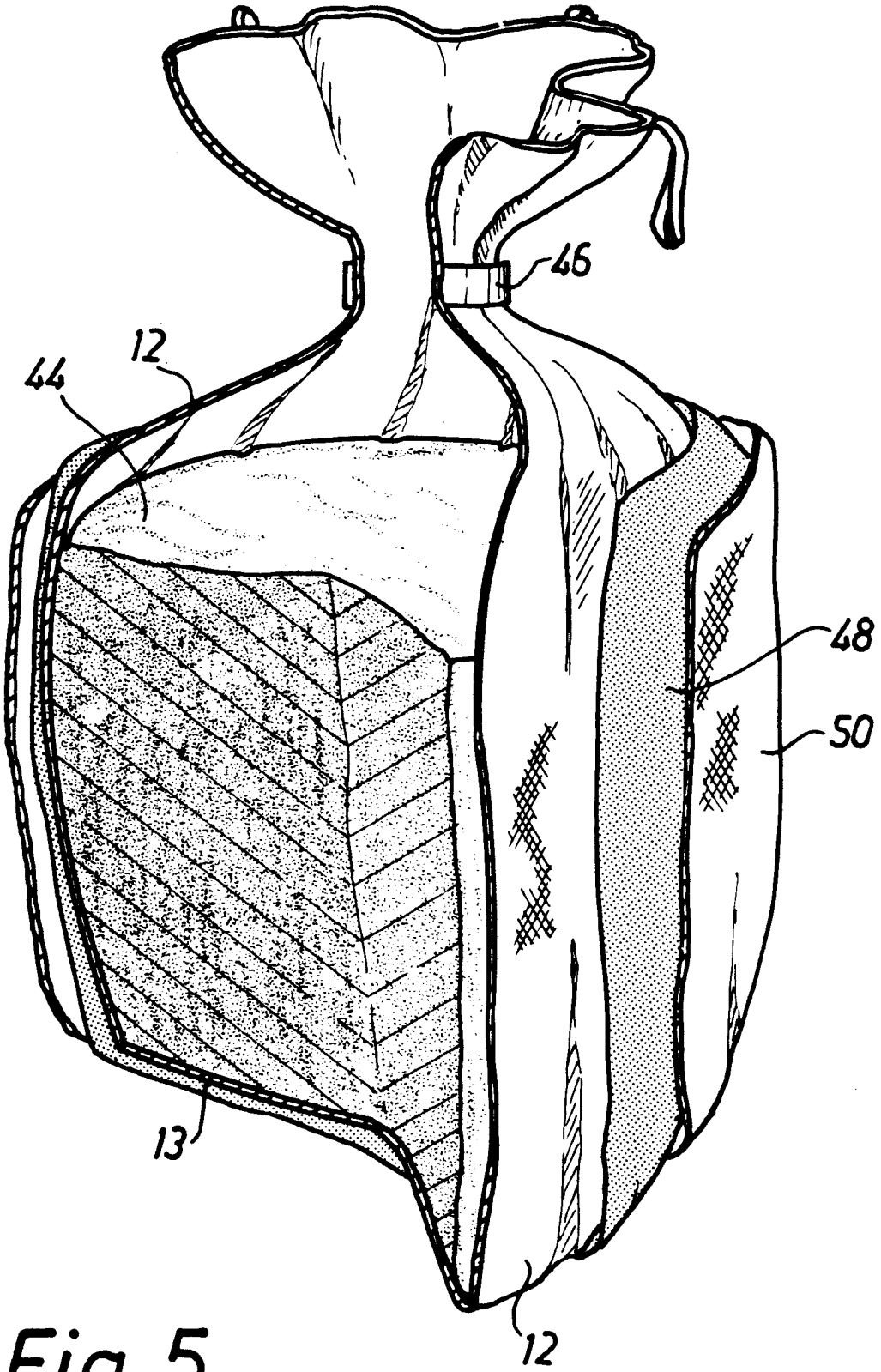
FIG. 5 is a partly out perspective view of an inner sack which, after dewatering of the waste placed therein, has been sealed and placed in a plastic sack and a carrying outer sack.

After the dewatering operation had been completed, the inner sack 12 was finally packed, as illustrated in FIG. 5, in which the waste is indicated by reference number 44. The top of the inner sack 12 was first sealed in suitable fashion, as schematically indicated at reference number 46, whereupon the sack was placed in a watertight plastic sack 48 which in turn was placed in a carrying outer sack 50 of essentially the same design and size as the inner sack 12, the straining-cloth bottom being, however, replaced with a bottom of the same or similar material as that of which the sides and top of the outer sack 50 are made. The resulting disposable container structure 12, 48, 50 may then be deposited below ground. The total volume was about 1 $m^3$, the weight was about 700 kg, and the largest outer dimensions were about 110×110×110 cm.

Modification with a Suction Box

In a further development of the apparatus shown in FIG. 1, the movable vacuum-suction nozzle 38 was replaced with a special suction box 52 of the type illustrated in FIGS. 3 and 4. This suction box 52 was disposed outside the collecting container 20, such that drip-dewatering and vacuum suction could be performed separately from the collecting container 20, which was advantageous in that a first sack could be drained with recirculation in the collecting container 20 while at the same time a second sack underwent drip-dewatering and vacuum suction adjacent to the suction box 52.

The suction box 52 has the advantage of obviating the need of moving the nozzle 38 over the straining-cloth bottom 13, since the suction box 52 produces simultaneous vacuum suction over the whole bottom 13 of the sack 12.

In this further development of the invention, the inner sack 12 was thus lifted by means of the travelling trolley 18 from the collecting container 20 after the drawing-off operation had been completed, whereupon it was moved in the lateral direction to a position above the suction box 52 and lowered onto it.

The suction box 52 comprises four sloping bottom elements 54, which together form an upper supporting surface for the sack 12 and which end in a central outlet opening 56. The outlet opening 56 was connected to the vacuum pump 40 in FIG. 1 in order to transfer void water collected in the suction box to the buffer tank 28. However, the void water collected in the suction box 52 need not necessarily be transferred to the buffer tank 28 but may optionally be treated and cleaned separately. Between the bottom elements 54, there is provided a total of four channels 58 for conducting the collected void water to the outlet opening 56 and distribute the negative pressure over the supporting surface of the suction box 52.

Naturally, the required durations of the recirculation, the drip-dewatering and the vacuum suction may deviate from the values given in the example above.

Furthermore, it is preferred, albeit not absolutely necessary, to make use of the plastic sack 48 and the outer sack 50. It will also be conceivable to embed the inner sack 12, although this is a more expensive alternative, and hence of less interest.

As to the inner sack 12, the straining-cloth material 13 need not necessarily cover the entire sack bottom, or may alternatively extend a certain distance up on the sides of the sack.

I claim:

1. A method for dewatering and containing radioactive, aqueous waste, comprising the steps of:

introducing radioactive, aqueous waste into a filtration container, the filtration container being an inner sack having a bottom provided with a straining cloth;

dewatering the waste in the inner sack such that substantially all dewatering of the waste is carried out through the straining cloth;

recirculating filtration water resulting from dewatering the waste through the waste in the inner sack for cleaning of the filtration water;

sealing the inner sack after dewatering the waste; and disposing of dewatered waste in a disposable container structure including the inner sack holding the dewatered waste and an outer container enclosing the inner sack.

2. A method as claimed in claim 1, wherein recirculation of the filtration water includes pumping the filtration water from a collecting container disposed below the inner sack to a sprinkler disposed above the inner sack and distributing the filtration water over the waste in the inner sack with the sprinkler.

3. method as claimed in claim 2, comprising the further step of applying a negative pressure to an outside of the of the inner sack.

4. A method as claimed in claim 1, comprising the further step of applying a negative pressure to an outside of the bottom of the inner sack.

5. A method as claimed in claim 4, wherein the dewatering includes a first step of suspending the inner sack holding the waste above a collecting container for collecting the filtration water, and a second step of moving the inner sack to a station separate from the collecting container and drip-dewatering the inner sack and applying a negative pressure to an outside of the bottom of the inner sack.

6. A method as claimed in claim 1, wherein the outer container is a carrying outer sack.

7. A method as claimed in claim 6, comprising the further step of sealing the inner sack in a watertight sack before enclosing the inner sack in the outer container.

8. A method as claimed in claim 6, comprising the further step of applying a negative pressure to an outside of the bottom of the inner sack.

9. An apparatus for dewatering and containing radioactive, aqueous waste, comprising:

a disposable container structure including an inner having an open top and a bottom provided with a straining cloth for dewatering radioactive, aqueous waste, and an outer container for enclosing the inner sack;

a collecting container for receiving filtration water resulting from dewatering waste in the inner sack;

suspension means for suspending the inner sack and the waste therein above the collecting container; and means for recirculating filtration water intercepted by the collecting container through the waste in the inner sack, wherein the inner sack is received in the outer container after the waste in the inner sack is dewatered by being suspended above the collecting container by the suspension means.

10. An apparatus as claimed in claim 9, further comprising means for applying a negative pressure to an outside of the bottom of the inner sack.

11. An apparatus as claimed in claim 10, wherein the means for applying a negative pressure comprises a suction box which is separate from the collecting container and which includes a supporting surface for supporting the inner sack and at least one opening formed in the supporting surface and in communication with a negative pressure source.

12. An apparatus as claimed in claim 10, wherein the outer container is a sack.

13. An apparatus as claimed in claim 10, wherein the inner sack is provided with lifting eyes at its open end for cooperating with the suspension means for suspension of the inner sack relative to the collecting container (20).

14. An apparatus as claimed in claim 10, wherein the inner sack is provided with a bottom reinforcement arranged on an outside of the straining-cloth bottom and connected to sides of the inner sack.

15. An apparatus as claimed in claim 10, wherein the inner sack has a volume of approximately 1 $m^3$.

16. An apparatus as claimed in claim 9, wherein the outer container is a sack.

17. An apparatus as claimed in claim 16, wherein the outer sack is provided with lifting eyes at an open end thereof.

18. An apparatus as claimed in claim 9, wherein the inner sack is provided with lifting eyes at its open end for cooperating with the suspension means for suspension of the inner sack relative to the collecting container (20).

19. An apparatus as claimed in claim 18, further comprising means for applying a negative pressure to an outside of the of the inner sack.

20. An apparatus as claimed in claim 9, wherein the inner sack is provided with a bottom reinforcement arranged on an outside of the straining-cloth bottom and connected to sides of the inner sack.

21. An apparatus as claimed in claim 9, wherein the inner sack has a volume of approximately 1 $m^3$.

* * * * *

UNITED STATES PATENT AND TRADEMARK OFFICE

CERTIFICATE OF CORRECTION

PATENT NO. : 6,040,491
DATED : March 21, 2000
INVENTOR(S) : Sony Sjöwall

It is certified that error appears in the above-identified patent and that said Letters Patent is hereby corrected as shown below:

Column 6,
Line 25, change "method as claimed" to read -- A method as claimed --.
Line 49, change "an inner having" to read -- an inner sack having --.

Signed and Sealed this

Nineteenth Day of February, 2002

*Attest:*

*Attesting Officer*

JAMES E. ROGAN
*Director of the United States Patent and Trademark Office*